US006357532B1

(12) United States Patent
Laskaris et al.

(10) Patent No.: US 6,357,532 B1
(45) Date of Patent: Mar. 19, 2002

(54) COMPRESSED AIR FOAM SYSTEMS

(75) Inventors: Michael A. Laskaris; Michael Sulmone, both of Collegeville, PA (US)

(73) Assignee: Hale Products, Inc., Conshohocken, PA (US)

( * ) Notice: Subject to any disclaimer, the term of this patent is extended or adjusted under 35 U.S.C. 154(b) by 0 days.

(21) Appl. No.: 09/399,442

(22) Filed: Sep. 17, 1999

(51) Int. Cl.[7] ..... A62C 3/00; B05B 7/00

(52) U.S. Cl. ..... 169/43; 169/14; 169/15; 169/44; 239/61; 239/310; 239/311; 239/407; 239/427; 239/427.3

(58) Field of Search ..... 169/14, 15, 43, 169/44; 239/61, 310, 311, 407, 427, 427.3

(56) References Cited

U.S. PATENT DOCUMENTS 3,234,962 A * 2/1966 Williamson ..... 169/14 X
5,096,389 A 3/1992 Grady
5,113,945 A * 5/1992 Cable ..... 169/14 X
5,145,014 A 9/1992 Eberhardt
5,255,747 A * 10/1993 Teske et al. ..... 169/15
5,411,100 A * 5/1995 Laskaris et al. ..... 169/14
5,427,181 A * 6/1995 Laskaris et al. ..... 169/14
5,582,776 A 12/1996 Crawley et al.
5,881,818 A * 3/1999 Lee et al. ..... 169/15
6,009,953 A 1/2000 Laskaris et al.

* cited by examiner

*Primary Examiner*—Robin O. Evans
(74) *Attorney, Agent, or Firm*—Akin, Gump, Strauss, Hauer & Feld, L.L.P.

(57) ABSTRACT

The present invention provides new compressed air foam systems for use as firefighting equipment. One compressed air foam system has a water inlet connected to a water flow path through the compressed air foam system. A water and foam chemical mixer is flow connected to the water inlet and has a foam chemical inlet and a water/foam chemical outlet. An air compressor is provided which has an air inlet, an air outlet, and an air flow controller at the air inlet. A foam mixer is flow connected to the water/foam chemical outlet of the water and foam chemical mixer and to the air outlet of the air compressor. The foam mixer has a foam outlet which provides firefighting foam to a fireman's hose for application to a fire. A control system has a sensor in sensing relationship with the water flow path through the compressed air foam system for sensing water flow. The control system is operatively connected to the air flow controller of the air inlet to the air compressor to the amount of air provided to the water/foam chemical mixture by restricting inflowing air into the air compressor.

6 Claims, 2 Drawing Sheets

COMPRESSED AIR FOAM SYSTEMS

FIELD OF THE INVENTION

The present invention generally relates to firefighting equipment, and more specifically, to compressed air foam systems used to mix a stream of water with foam chemical and air to produce a water/foam/air mixture for firefighting purposes. Even more specifically, the present invention relates to systems and methods for controlling the introduction of air into the water and foam chemical mixture.

BACKGROUND OF THE INVENTION

The addition of foaming agents to firefighting water streams is known and can be particularly useful for fighting fires, for example, fires in industrial factories, chemical plants, petrochemical plants and petroleum refineries. The use of compressed air firefighting foam requires that air and a foam concentrate be mixed and added at constant proportions to the water stream. When the foam extinguisher solution is delivered, the foam effectively extinguishes the flames of chemical and petroleum fires as well as Class A materials which would otherwise not be effectively extinguished by the application of water alone.

It is important that the foam concentrate be added to the water stream in the appropriate proportion. When an excessive amount of foam concentrate is added, a lower fire-extinguishing quality can result due to an increased foam viscosity which limits the flowability of the foam and the ability of the foam to be spread on the fire. Further, the addition of excessive amounts of concentrate to the water stream increases the cost of the use of the foam and the frequency at which the foam concentrate supply must be replenished at the scene.

It is also important that the amount of air added to the water and foam chemical mixture be properly regulated, i.e. added in the appropriate proportion. The amount of air introduced into the water and foam chemical mixture is controlled to achieve the desired consistency of foam. Firefighting foam that is either too watery due to insufficient air or too dry due to excessive air is less effective at fighting fires and may even be dangerous. The condition in which an excessive amount of air is introduced with the nozzle closed to create the foam is commonly referred to as air packing or just packing of the hose.

As the nozzle operated by the firefighter at the end of the hose line is closed, extra air or water will tend to flow into the hose line depending on which one has a higher pressure. This may contribute to an unbalanced foam mixture. Existing firefighting foam systems have had difficulties in maintaining the pressures of the water and air equal to each other. Some firefighting foam systems, such as the CAFSMaster available from Hale Products, Inc., Conshohocken, Pa., recognized this and actually proportion the air introduced into the water using a venturi device. However, existing air proportioned systems generally increase the size and weight of the firefighting foam system. Other firefighting foam systems use an operator to control the introduction of air by constantly making manual adjustments to maintain a desired foam mixture.

Existing firefighting foam systems have attempted to control the introduction of air by adjusting an air valve on the discharge side of an air compressor used to supply air to generate the foam. However, the air compressor continues to place an unnecessary load on the engine used to provide power for firefighting equipment. Engine power that would otherwise be available for other firefighting activities is reduced due to the unnecessary air compressor load. Also, the air compressor continues to burn fuel and experience wear and tear unnecessarily.

In addition to controlling the introduction of air into the water and foam chemical stream to achieve a desire foam consistency, it is also desirable to reduce the air flow or completely shut off the air flow under certain conditions. For example, if foam chemical is not being added to the water then air should be prevented from being introduced into the water stream. Air and water do not mix under pressure. If air is added to the water without the foam chemical the unmixed air and water will cause violent surging of the firefighting hoses, commonly called slug flow. The violent surging action can be sufficiently forceful to knockdown or injure the firefighter who is operating the fire hose.

Examples of existing foam generating systems can be found in U.S. Pat. No. 5,096,389 to Grady, entitled Compressed Air Foam Discharging Apparatus, and U.S. Pat. No. 5,582,776 to Crawley et al., entitled Apparatus for Generating Foam.

In view of the existing firefighting foam mixing equipment, there are needs to have new compressed air foam systems. There are particular needs for new compressed air foam systems which control the introduction of air into the mixture to generate the foam.

SUMMARY OF THE INVENTION

The present invention provides compressed air foam systems which generate compressed air foam, for firefighting, for example. The new compressed air foam systems increase safety for relatively small, simple foam generation units by employing a flow sensing element into the foam proportionor design to regulate and turn the air flow from the air compressor off when water flow is shut off. In one embodiment of the present invention, a flow sensor senses the position of a piston in a foam proportionor which provides a signal indicative of water flow. The control system actuates an air flow regulator on the air intake to an air compressor which controls the amount of air mixed into the stream or even shuts off the air flow. Accordingly, the present invention includes new air flow control systems for compressed air foam systems.

Furthermore, the air flow can be shut off when various conditions occur, for example, the error conditions of: out of foam chemical, foam system failure, and foam proportioner in an off condition when attempting to generate compressed air foam.

The compressed air foam system of the present invention is a self-contained system that fits in a cabinet on a side of a fire truck and can be retrofitted to a fire truck. The compressed air foam system may be small enough in size to fit in a European fire truck compartment, such as a DIN 8 kVA generator compartment, commonly found in European fire trucks.

Compressed air foam technology further improves the firefighting capacity of water and foam chemicals by producing a higher energy stream that penetrates the fire and by producing a higher quality foam bubble structure than is obtainable by other methods. As an additional benefit, compressed air foam lines are lighter than water lines and place less stress on the firefighters and allow a greater degree of mobility. This facilitates reduced water damage, quicker fire knockdown and a resultant "safer" environment for both the firefighters and potential victims.

Objects and advantages of the present invention will become apparent upon reading this disclosure including the appended claims and with reference to the accompanying drawings. The objects and advantages may be desired, but may not necessarily be required to practice the present invention.

DETAILED DESCRIPTION OF PRESENTLY PREFERRED EMBODIMENTS

Although the present invention can be made in many different forms, the presently preferred embodiments are described in this disclosure and shown in the attached drawings. This disclosure exemplifies the principles of the present invention and does not limit the broad aspects of the invention only to the illustrated embodiments.

Figure 1:
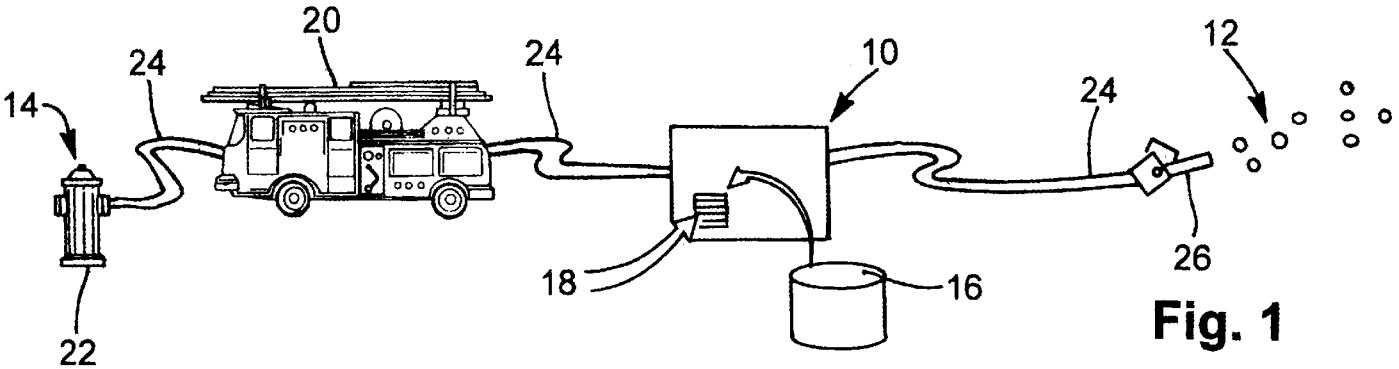
FIG. 1 is a schematic illustration of a compressed air foam system according to the principles of the present invention.

A new compressed air foam system 10 according to the principles of the present invention to make compressed air foam 12 is shown by way of example in FIG. 1. The compressed air foam 12 is used to fight fires. The three components of the compressed air foam 12 are water 14, foam chemical 16, and air 18.

The compressed air foam system 10 is a self contained module that adds foam chemical 16 and air 18 to a water flow 14 to make compressed air foam 12. When combined in the proper ratios the compressed air foam mixture 12 is significantly better at suppressing fire than plain water or water and foam chemical alone. This means that a plain water flow from any water pumping device (such as a fire truck 20, for example) or a hydrant 22 of sufficient flow and pressure can be used to generate compressed air foam 12 by running the water through the compressed air foam system 10. Fire hoses 24 can be used to connect the compressed air foam system 10 to the source of supply water and to a nozzle 26 operated by a fireman for delivery of the foam 12 to the fire.

The compressed air foam system 10 can be used with various foam chemicals 16 used to generate the foam 12. For firefighting purposes, the foam chemical 16 generally refers to firefighting foam chemical additives of the Class A or B variety. These firefighting foam chemicals are generally known and used in the firefighting service. The compress ed air foam system 10 is generally used much more frequently with Class A foam than with Class B foam.

Figure 2:
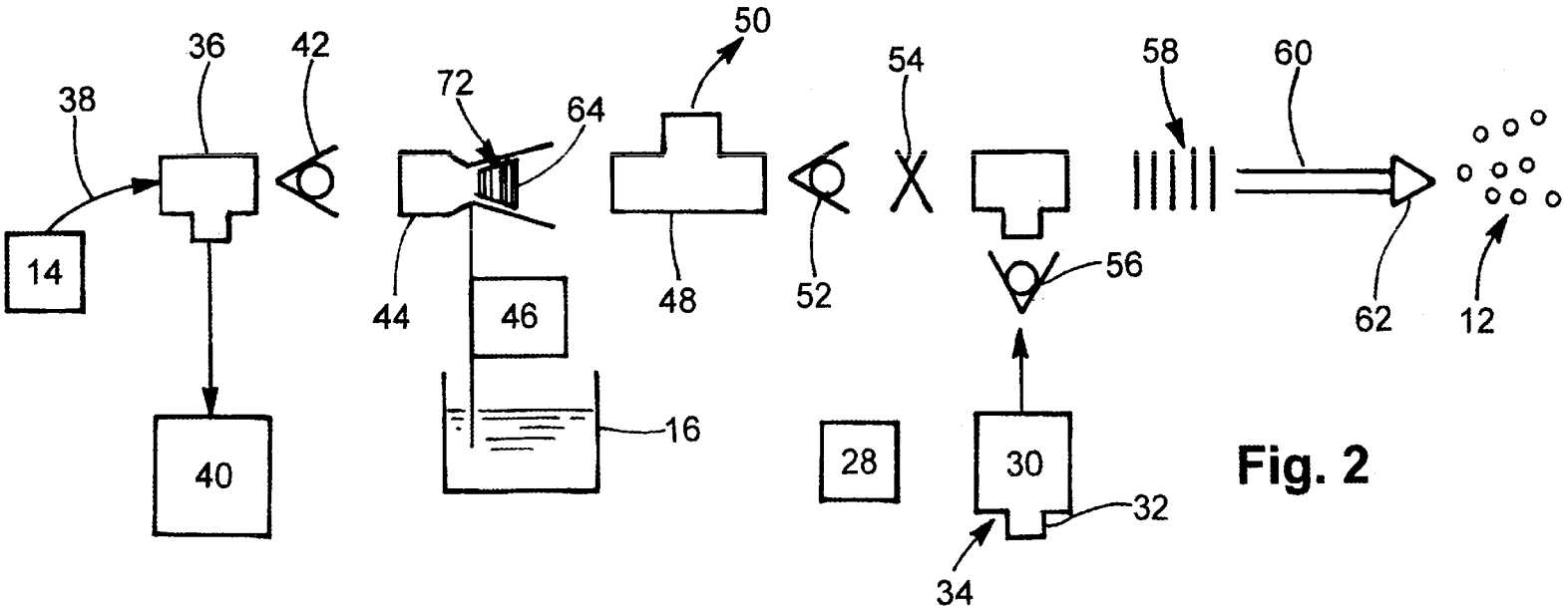
FIG. 2 is another schematic illustration of the compressed air foam system of FIG. 1.

Referring to FIG. 2, the compressed air foam system 10 has a power source 28 or is connected to a power source. For example, the power source 28 may be a Briggs and Stratton 18 horsepower gasoline engine; however, the power source 28 could be any gas or diesel power plant. Furthermore, the power source 28 could be an electric motor or hydraulic drive system, or even a power take-off drive from a gear box or a fire truck transmission. The engine power source 28 may run at full speed all the time, for example, typical full speed for a small engine is in the 3600–4000 rpm range.

The power source 28 is operatively coupled to an air compressor 30. The power source 28 provides sufficient power and speed to run the air compressor 30. The air compressor 30 typically runs at a constant speed in the compressed air foam system 10. The air compressor 30 can be a rotary compressor, a reciprocating type compressor, or other compressor as well. One compressed air foam system 10 has a reversing belt serpentine drive with a double sided timing belt that drives the air compressor 30 and allows the shaft of the air compressor 30 to be face to face with the engine 28 output shaft.

The air compressor 30 is fitted with an intake throttling valve 32. The air compressor intake regulator 32 allows the control of the air discharge pressure from the air compressor 30 by throttling the air intake of the compressor 30 at an air inlet 34. Suitable air intake throttling valves 32 are available from AirCon, Erie, Pa. Decreasing the air flow into the air compressor 30 will reduce the airflow out of the air compressor 30. This will allow the outlet air pressure to be controlled across any compressor discharge orifice. This, of course, also varies the flow of air being discharged from the air compressor 30. The air intake valve 32 can be pilot operated and controlled by a pilot regulator, such as those available from AirCon, Erie Pa., in a fashion common to industrial compressors.

Water 14 from a water source 22 enters the compressed air foam system 10 at a water inlet 36 and passes through a water flow path 38 through the system 10. A portion of the water flow into the compressed air foam system 10 can be water bled off and fed to a heat exchanger 40, such as a water to oil heat exchanger, to keep the air compressor 30 cool. The water leaving the heat exchanger 40 can be fed to any desired location, such as back to a water tank on the fire truck, for example. The water provided to the heat exchanger 40 does not contain the foam chemical 16.

The water 14 flows from the water inlet 36 through a check valve 42 to prevent any foam chemical 16 from back flowing into the heat exchanger 40. The water 14 next enters a water and foam chemical mixer 44 to mix the water 14 and foam chemical 16 together. The foam chemical 16 may be fed into the water and foam chemical mixer 44 by a pump 46. One example of a water and foam chemical mixer 44 (proportioning device) is described in copending U.S. patent application Ser. No. 09/007,582, titled Foam Proportioner System, which is incorporated herein by reference. In the water and foam chemical mixer 44, the foam chemical 16 is added in the correct proportion to the water flow. Typically Class A foam chemical is added at 0.3 to 0.5 percent.

The foam solution (foam chemical and water mixture) passes through a tee 48 to provide plain foam solution 50 to specified firefighting discharges, if desired.

The remaining foam solution passes through another check valve 52 to prevent backflow of compressed air foam 12 into the foam solution lines. A ball valve 54 controls but does not shut off the solution flow rate (typically a 2 or 2.5 inch ball valve). After the ball valve 54 the air is injected from an air outlet of the air compressor 30 through an air discharge check valve 56. The foam solution is turned into the compressed air foam 12 using motionless mixers 58, such as those described in U.S. Pat. No. 5,427,181 to Laskaris et al. The finished compressed air foam 12 is routed to hose lines 60 with shut off valves 62 (such as a nozzle) for use on the fire.

The compressed air foam system 10 utilizes a new control system to prevent problems and operator errors in generating compressed air foam, while maintaining a small package. The control system may be constructed of mechanical relays, electronic circuits, and combinations thereof.

Figure 3:
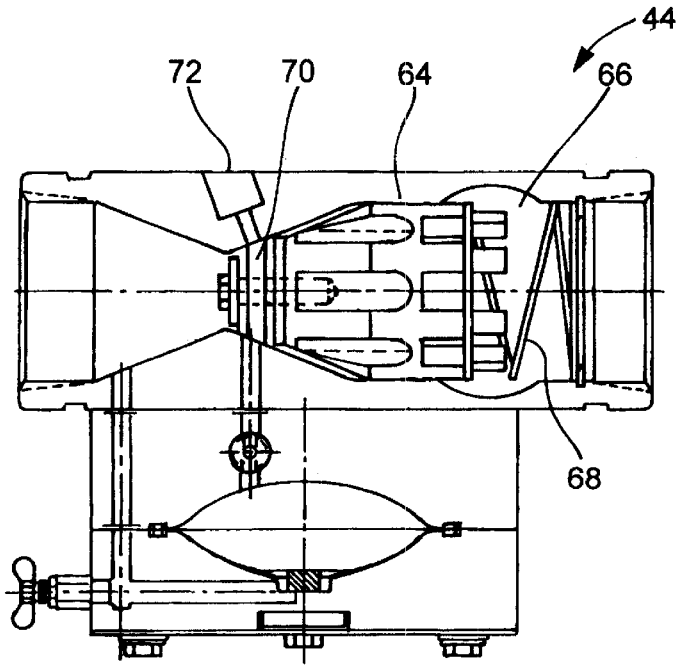
FIG. 3 is a schematic illustration of a foam proportioner of the compressed air foam system of FIG. 1.

Referring to FIG. 3, the water and foam chemical mixer 44 (foam proportioning device) is shown. The water and foam chemical mixer 44 contains a non-metallic piston 64 that resides inside the non-ferrous venturi 66. The piston 64 displacement against a spring 68 is caused by water flow and can be utilized for sensing water flow. The piston 64 has a portion which is a corrosion resistant magnetic alloy, such as a stainless steel washer 70. An inductive proximity switch 72 is used to sense the position of the piston 64 by sensing the metallic portion 70. The amount of water flow can be determined by knowing the position of the piston 64 in the foam proportioner 44. The water flow signal from the proximity sensor 72 can be used to trip a solenoid that sends a signal to the intake valve 32 on the air compressor 30 to adjust the air intake. In this manner, the output pressure of the air compressor 30 can be controlled.

If the water flow signal indicates that no water is flowing, the control system can completely close the air intake valve 32 on the compressor 30 which will stop the flow of air. Water cannot flow from the mixer 58 back into the compressor 30 because the air discharge check valve 56 shuts as soon as the air flow from the compressor 30 stops. Reducing the discharge pressure of the air compressor 30 places less load on the engine used to run the compressor 30, such as a small air cooled engine, when no air flow is required.

Figure 4:
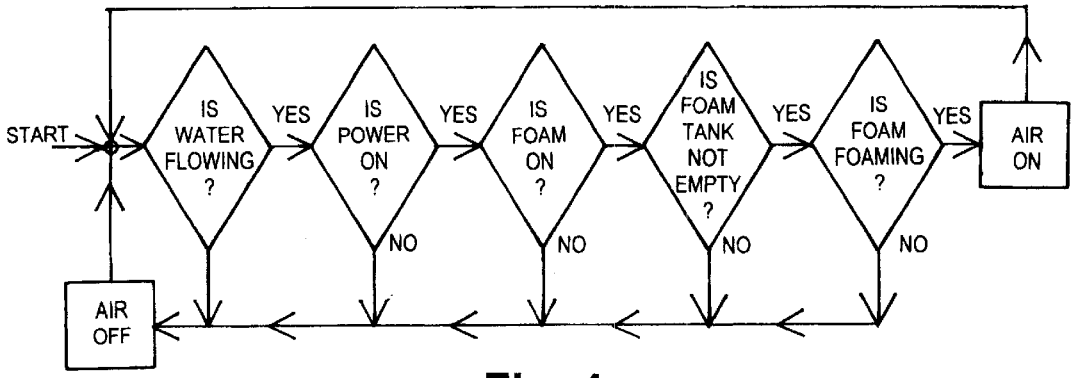
FIG. 4 is a flow chart illustrating a logical control system of the compressed air foam system of FIG. 1.

Referring to FIG. 4, additional sensors can be included in the control system to control the air flow into and out of the compressor 30. The sensors detect a particular parameter and have a parameter signal indicative of the parameter. The control system utilizes the parameter signal to actuate the air flow controller 32 based on the parameter signal. For example, if the operator forgets to turn on the water and foam chemical mixer 44 or any other type of foam system in the compressed air foam system 10, slug flow may result. In order to prevent the slug flow a sensor which senses whether the foam proportioner 44 is ON sends a parameter signal which can be combined with the proximity sensor 72 signal in a logical "AND" fashion. The air flow from the compressor 30 is turned OFF is the power to the water and foam chemical mixer 44 is OFF. Therefore, before air is injected into the flow stream path in the compressed air foam system 10, there must be waterflow and the foam system must be on.

Furthermore, by interlocking a foam flow switch and foam chemical low tank level switch several other operator errors can be avoided. If the system runs out of foam chemical or the foam unit breaks down the air is automatically turned off preventing the dangerous slug flow. Also, the operator does not have to close an air valve to prevent packing.

The ball valve 54 is used to make drier foam by restricting the water content of the mixture. When making this drier foam, the prevention of packing is even more important to provide a usable firefighting stream when the nozzle 26 is opened. In addition the ball valve 54 should be configured so that it cannot be completely shut off. A stop, hole in the ball, or a cut in the valve seat of the ball valve 54, for example, can be used to ensure plain air without water is not discharged from the nozzle 62.

While the presently preferred embodiments have been illustrated and described, numerous changes and modifications can be made without significantly departing from the spirit and scope of this invention. Therefore, the inventors intend that such changes and modification are covered by the appended claims.

We claim as our invention:

1. A compressed air foam system comprising:

water flow path through the compressed air foam system, the water flow path having a water inlet;

a water and foam chemical mixer flow connected to the water inlet, the water and foam chemical mixer having a foam chemical inlet and a water/foam chemical outlet;

an air compressor having an air inlet, an air outlet connected to the water flow path, and an air flow controller at the air inlet; and a control system operatively connected to the air flow controller of the air inlet to the air compressor, the control system having a proximity sensor in the water and foam chemical mixer, the proximity sensor located in sensing relationship to a movable flow control piston and in sensing relationship with the water flow path through the compressed air foam system, the flow control piston having a metallic portion located adjacent the proximity sensor.

2. A compressed air foam system comprising:

a water flow path through the compressed air foam system, the water flow path having a water inlet;

a water and foam chemical mixer flow connected to the water inlet, the water and foam chemical mixer having a foam chemical inlet and a water/foam chemical outlet;

a water take-off upstream of the water and foam chemical mixer;

an air compressor having an air inlet, an air outlet connected to the water flow path, and an air flow controller at the air inlet; and a control system having a sensor in sensing relationship with the water flow path through the compressed air foam system, the control system operatively connected to the air flow controller of the air inlet to the air compressor.

3. A compressed air foam system comprising:

a water flow path through the compressed air foam system, the water flow path having a water inlet;

a water and foam chemical mixer flow connected to the water inlet, the water and foam chemical mixer having a foam chemical inlet and a water/foam chemical outlet;

a foam solution take-off downstream of the water and foam chemical mixer and upstream of a foam mixer flow connected to the water and foam chemical mixer;

an air compressor having an air inlet, an air outlet connected to the water flow path, and an air flow controller at the air inlet; and a control system having a sensor in sensing relationship with the water flow path through the compressed air foam system, the control system operatively connected to the air flow controller of the air inlet to the air compressor.

4. A method of generating compressed air foam comprising the steps of:

flowing water through a flow path through a compressed air foam system;

mixing the water and a foam chemical in a foam proportionor to produce a water and foam chemical mixture;

mixing air from an air compressor into the water and foam chemical mixture to generate compressor air foam;

sensing a flow rate in the flow path;

sensing a position of a piston in the foam proportionor; and regulating air intake into the air compressor based on the sensed flow rate.

5. A compressed air foam system comprising:

a water flow path through the compressed air foam system, the water flow path having a water inlet;

a water and foam chemical mixer flow connected to the water inlet, the water and foam chemical mixer having a foam chemical inlet and a water/foam chemical outlet;

a foam mixer flow connected to the water/foam chemical outlet of the water and foam chemical mixer and to the air outlet of the air compressor, the foam mixer having a foam outlet;

an air compressor having an air inlet, an air outlet connected to the water flow path, and an air flow controller at the air inlet; and a control system having a sensor in sensing relationship with the water flow path through the compressed air foam system, the control system operatively connected to the air flow controller of the air inlet to the air compressor.

6. A compressed air foam system comprising:

a water flow path through the compressed air foam system, the water flow path having a water inlet;

a water and foam chemical mixer flow connected to the water inlet, the water and foam mixer having a foam chemical inlet and a water/foam chemical outlet;

a foam mixer flow connected to the water/foam chemical outlet of the water and foam chemical mixer and to the air outlet of the air compressor, the foam mixer having a foam outlet, the foam mixer being a motionless mixer;

an air compressor having an air inlet, an air outlet connected to the water flow path, and an air flow controller at the air inlet; and a control system having a sensor in sensing relationship with the water flow path through the compressed air foam system, the control system operatively connected to the air flow controller of the air inlet to the air compressor.

* * * * *